US009707796B2

(12) United States Patent
Kovacevitch

(10) Patent No.: US 9,707,796 B2
(45) Date of Patent: Jul. 18, 2017

(54) DOCUMENT PROVIDED WITH A DEVICE FOR SECURING CONFIDENTIAL INFORMATION MENTIONED IN THE DOCUMENT AND METHOD FOR IMPLEMENTING SUCH A DEVICE

(71) Applicant: Michel Kovacevitch, Dubai (AE)

(72) Inventor: Michel Kovacevitch, Dubai (AE)

( * ) Notice: Subject to any disclaimer, the term of this patent is extended or adjusted under 35 U.S.C. 154(b) by 0 days.

(21) Appl. No.: 15/120,251

(22) PCT Filed: Mar. 13, 2014

(86) PCT No.: PCT/IB2014/000475
§ 371 (c)(1),
(2) Date: Aug. 19, 2016

(87) PCT Pub. No.: WO2015/150849
PCT Pub. Date: Oct. 8, 2015

(65) Prior Publication Data

US 2017/0066275 A1 Mar. 9, 2017

(51) Int. Cl.

| | |
|---|---|
| ***B42D 15/02*** | (2006.01) |
| ***G09F 3/18*** | (2006.01) |
| *G09F 3/02* | (2006.01) |

(52) U.S. Cl.
CPC ..... *B42D 15/025* (2013.01); *G09F 3/185* (2013.01); *G09F 2003/0222* (2013.01); *G09F 2003/0276* (2013.01)

(58) Field of Classification Search
CPC .. B42D 15/025; Y10T 428/15; Y10T 428/149
(Continued)

(56) References Cited

U.S. PATENT DOCUMENTS 6,686,014 B1 * 2/2004 Washburn ..... G09F 3/10 428/42.3
2010/0013209 A1 * 1/2010 Kovacevitch ..... B42D 15/025 283/74

FOREIGN PATENT DOCUMENTS

| | | | |
|---|---|---|---|
| FR | 2827217 | A1 | 1/2003 |
| WO | 2007144486 | A2 | 12/2007 |
| WO | 2009103021 | A1 | 8/2009 |

* cited by examiner

*Primary Examiner* — Kyle Grabowski

(57) ABSTRACT

The invention relates to a document (1) which is provided with a device for securing confidential information mentioned in the document, the latter comprising:

Figure 1:
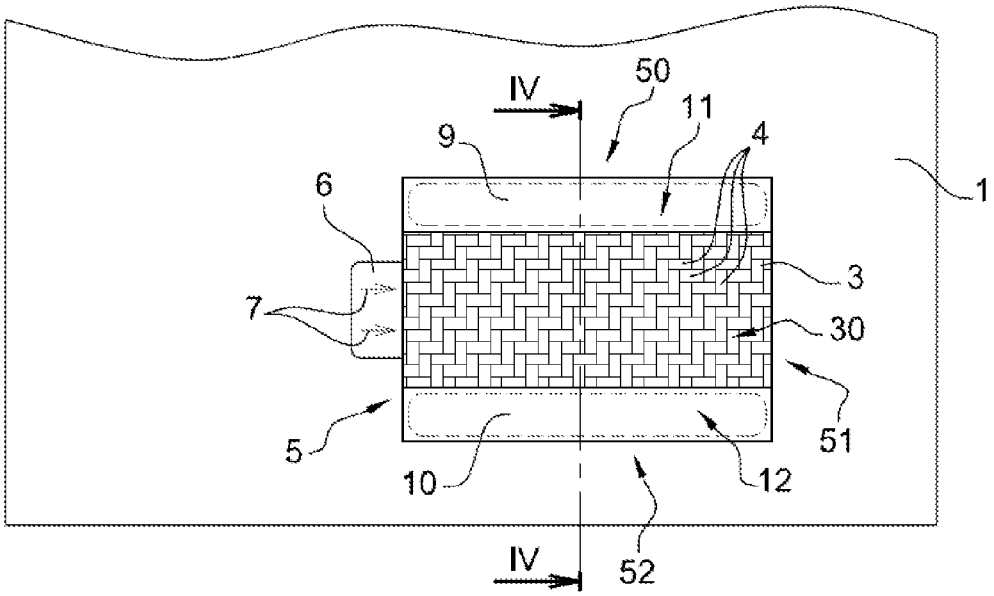

a window (8) cut into said document, at least two areas of structural weakness (11, 12) located adjacent to two edges (81, 83) of the window (8), an information support element formed by at least a first label (16) secured to one face (18) of the document (1) such that the confidential information printed on said label (16) is located in the window (8), an element (3) for masking the information, with dimensions at least equal to those of the window (8), permanently secured to the areas of structural weakness (11, 12) and removably mounted at the window (8). A second label (19), suitable for protecting the first label (16) and for allowing the confidential information to be read when the masking element (3) is lifted, is arranged in the window (8) of the document (1), from the face (20) of the document (1) opposite the face (18) which is provided with the first label (16), the dimensions of said second label (19) being smaller than those of the window (8). The masking element (3) is also located on the face (20) of the document and furthermore has dimensions that enable the element to be permanently secured, by all the sides thereof, to the document
(Continued)

adjacent to all the edges of the window (8), including those which lack structural weakness zones (11, 12). The invention also related to a method for implementing such a document.

14 Claims, 3 Drawing Sheets

(58) Field of Classification Search
USPC ..... 283/81, 101, 103, 105, 901, 903; 428/42.3, 43
See application file for complete search history.

DOCUMENT PROVIDED WITH A DEVICE FOR SECURING CONFIDENTIAL INFORMATION MENTIONED IN THE DOCUMENT AND METHOD FOR IMPLEMENTING SUCH A DEVICE

The present invention relates to a document provided with a device for securing confidential information mentioned in the document and a method for implementing this security device.

Here, a document is used to communicate, to at least a given recipient, confidential information in the form of an alphanumeric code, for example. Alternatively, the information is not encoded but written in a language understood by only the recipient(s). This type of document finds application in the fields of banking, insurance, telecommunications, healthcare, gaming and more generally in any field where restricted information circulates, i.e. intended for a limited number of identified persons.

The confidentiality of the information should be maintained when the document circulates between the sender and recipient while allowing the latter rapid access to the information. For this, it is known to conceal the information mentioned on a document by a mask, the recipient removing the mask, by scraping for example, in order to gain access to the information. However, it turns out that not only is it possible, under certain lighting, to read the information through the mask, but also that scraping off the mask can damage or even destroy the information mentioned on the document. In addition, once the masking has been scratched away and the information read, it is possible to place a mask back on the information, making it appear as though it had never been read.

It is helpful to ensure that the information can only be read for the first time by the defined recipient(s). It is therefore helpful to check that, before the recipient reads the information, no one has had access to the information, despite the presence of the information security device. For this, WO-A-2007144486 describes a document provided with a window cut out in the document. Two protective elements are secured to the two faces of the document, at the window. The information is printed on one face of an element intended to be in contact with a face of the other element. Thus, the information is positioned in the window, with the two elements protecting the information on each face of the document. A third masking element is removably mounted on one face of the document so as to hide the information that is located in the window and mentioned between the two elements. The various elements are formed by labels. The masking element is larger than the window, thereby covering it completely. Two overhanging parts of the masking element are permanently secured to the precut areas of the document. These precut zones are located along two parallel sides of the window. When the masking element is removed, owing to a gripping tab provided on an edge of the masking element, the precut areas are ripped at the same time the information is accessed, as a result of the masking element being secured to these areas.

That said, the invention aims to propose another document provided with a security device overcoming the drawbacks of the prior art mentioned above, particularly by improving the efficiency of the security device.

To this end, the invention relates to a document provided with a device for securing confidential information mentioned in the document, the latter comprising:

a window cut into said document, at least two areas of structural weakness located adjacent to two edges of the window, an information support element formed by at least one first label secured to one face of the document such that the confidential information printed on said label is located in the window, an element for masking the confidential information, with dimensions at least equal to those of the window, permanently secured to the areas of structural weakness and removably mounted at the window, characterized in that a second label forming part of the information support element adapted to protect the first label and to enable the confidential information to be read when the masking element is removed, is arranged in the window of the document, from the face of the document opposite to that provided with the first label on which the confidential information is printed, the dimensions of the second label being smaller than those of the window, and in that the masking element is also located on the face of the document opposite that provided with the first label on which the confidential information is printed, said masking element further having dimensions such that it is permanently secured, by all its sides on the document, adjacent to all the edges of the window, including those without areas of structural weakness.

The invention thus enables the previously mentioned objectives to be attained.

As the entire periphery of the masking element is integral with the document, it is no longer possible to raise a portion thereof to access the information. The latter is located on an element always positioned in the window, on the face of the document although independent of the masking element which is positioned on the other face of the document. The second label positioned in the window allows the information to the read when the masking element is removed, while avoiding degradation of the label supporting the information when the masking element is removed. Such a configuration further facilitates the implementation steps of the invention while optimizing the total thickness of the security device on the document by distributing the number of constituent elements of the device on the two faces of the document.

According to advantageous but non-mandatory aspects of the invention, such a document may include one or more of the following characteristics:

The dimensions and shape of the first label supporting the information are adapted to cover the window and part of the document forming the edges of the window, excluding areas of structural weakness.

The masking element and the first label are secured by strong and non-repositionable adhesive to the two opposite faces of the document, respectively.

The second label is secured to the first label by means of a strong and non-repositionable adhesive.

The face of the second label in contact with the masking element, at the window, is free of adhesive.

The face of the second label in contact with the masking element, at the window, is secured to said masking element by a weak and repositionable adhesive.

The first and second labels, and the masking element are made of a transparent material.

The first label is made of a transparent and matte material.

The second label is made of a transparent and glossy material, such as PET.

The invention also relates to a method for implementing a document equipped with a device for securing confidential information according to one of the preceding features, characterized in that it comprises at least the following steps:

a) make a cutout, defining a window, in a document, b) define two areas of structural weakness parallel to two sides of the window and adjacent to said sides, c) secure a first label forming part of the information support element to the document so that it covers the entire window without overlapping on the areas of structural weakness, d) secure, at the window, a second label forming part of the information support element on the first label previously secured to the document in step c), the second label not overlapping the window, e) turn the document over to secure a masking element to the document so that it covers the entire window, the second label, the perimeter of the window and the areas of structural weakness, from the face of the document opposite that on which the first label forming part of the information support element is secured, f) turn the document over to print the confidential information on the free face of the first label, so that the information is positioned in the window.

According to advantageous but non-mandatory aspects of the invention, such a method may include one or more of the following steps:

The steps a) and b) for cutting out the window and creation of the areas of structural weakness are performed simultaneously.

The step b) for creating the areas of structural weakness is performed prior to step a).

The steps d) and e) for securing the second label and the masking element are performed simultaneously, the second label being pre-positioned on the masking element.

The step f) for printing the information is performed in a location and/or at a time different from the other steps.

Figure 2:
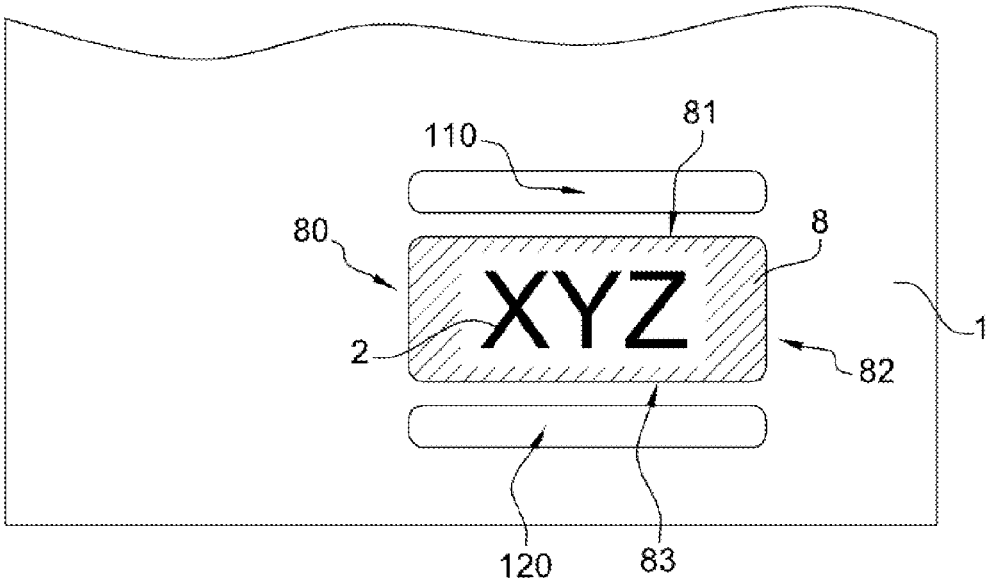
Figure 3:
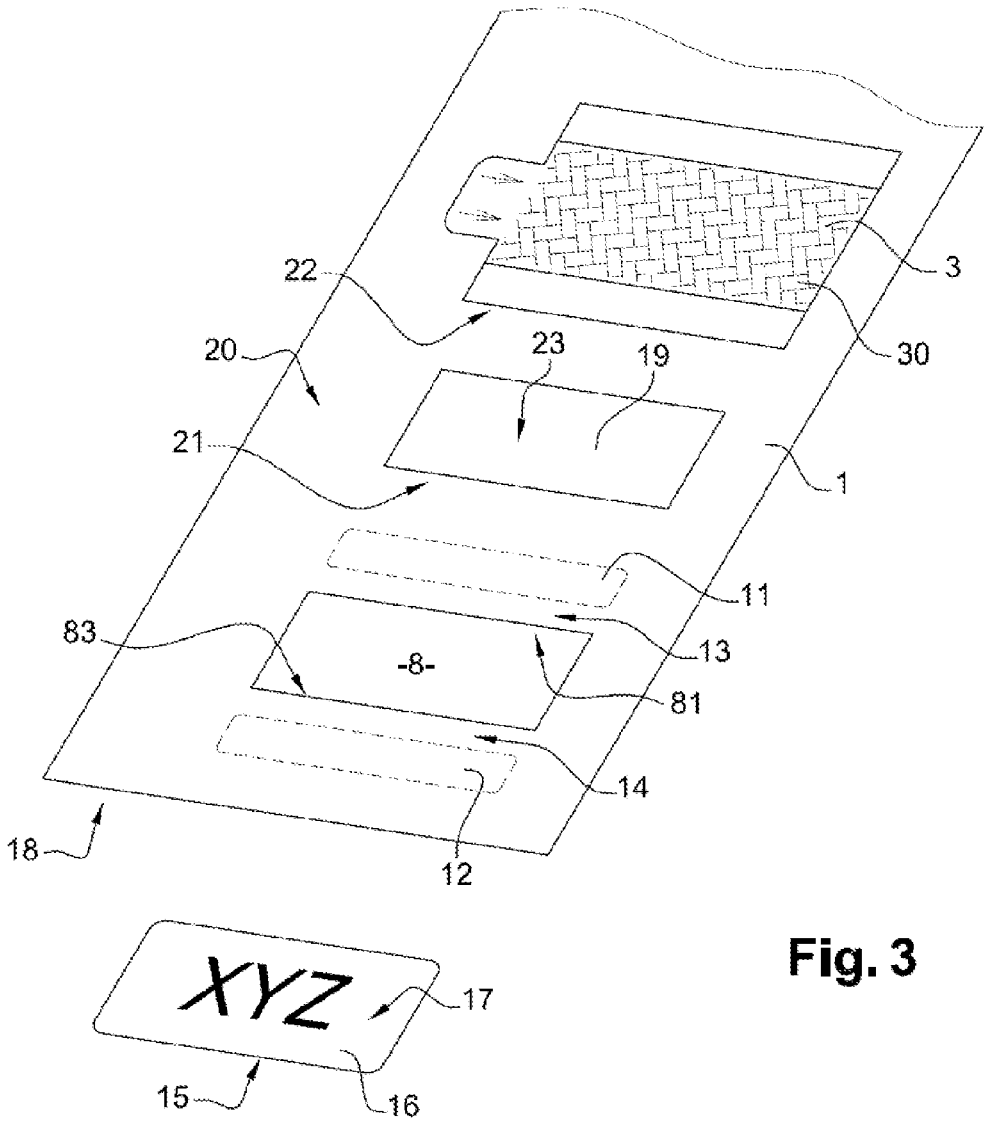
Figure 4:
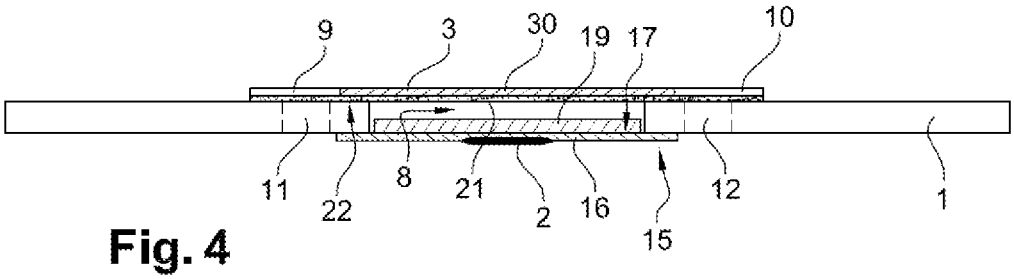
Figure 5:
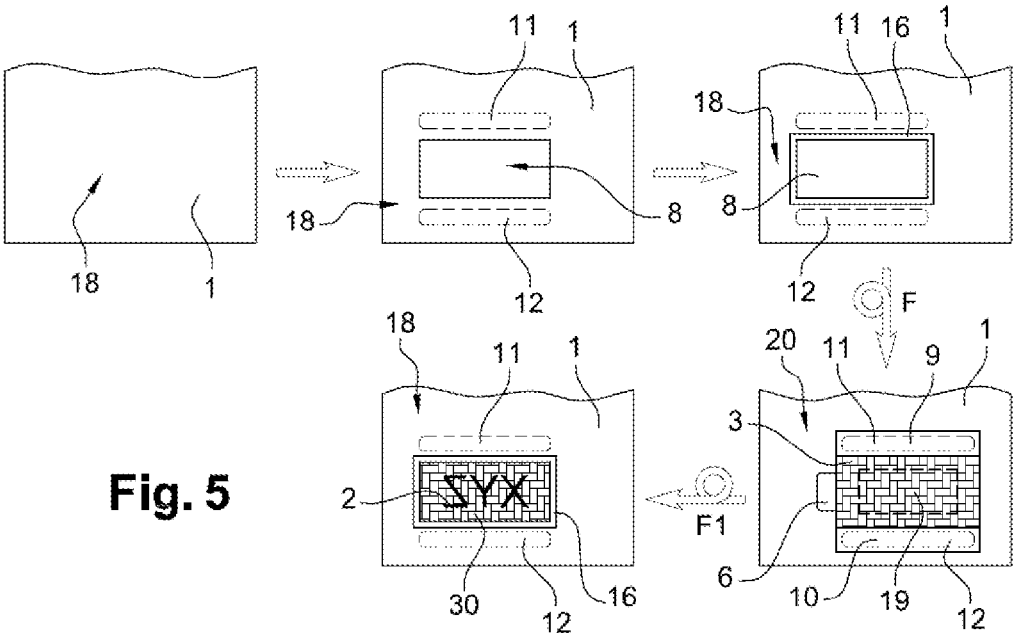

The invention will be better understood and other advantages thereof will become more apparent upon reading the following description of an embodiment of the invention that will follow, given solely as a non-limiting example and with reference to the accompanying drawings, wherein:

FIG. 1 is a schematic view illustrating a face of a document, partially represented, equipped with a device for securing the information, according to the invention, FIG. 2 is a view similar to FIG. 1 and in the same scale, illustrating the document of FIG. 1 when the device for securing the information has been removed, the information then being visible and the areas of structural weakness have been torn away, FIG. 3 is a schematic view, in a different scale, illustrating the constituent elements of a document as shown in FIG. 1, in the pre-mounting configuration, FIG. 4 is a sectional view, in larger scale, along the line IV-IV, and FIG. 5 is a schematic diagram and in a smaller scale, illustrating the steps of a method for implementing the device for securing information on a document according to the invention.

The document 1 illustrated in the various figures is a sheet of paper. Such a document may also be made of another material, for example a polymer-based material or a vegetable-fiber based material such as linen or cotton. In all cases, the document 1 is adapted to include at least information 2 that is confidential in nature, i.e. intended for one person or a predefined number of persons. It is easy to see that non-confidential information can also be present on the document 1. In all cases, the information 2 is applied to the document 1 by techniques known per se, advantageously by printing. For this purpose, the dimensions of the document 1 are standardized to allow for the use of printing machines commonly encountered in the printing industry. In particular, the dimensions of the document generally correspond to the A4 format, i.e. 21 cm×29.7 cm. It is easy to see that the document may have all dimensions commonly used in office automation, printing and/or copying.

Here, the confidential information 2 that is mentioned in the document 1 is an alphanumeric code. Alternatively, it may be a color code, text or other type of confidential information, such as a barcode or a flashcode. Such information is often intended to allow a given device or product to be used, such as a bank card or a telephone. Alternatively, such information gives access to a given location or predefined data, such as a database. In all cases, this confidential information is secured by a device described with reference to FIGS. 1 to 5.

FIG. 1 illustrates an embodiment of the invention wherein the confidential information 2 is located on a part of a document 1, in this case adjacent to the lower right-hand corner in reference to FIG. 1. Document 1 is partially represented, to facilitate the legibility of the figures.

When the document 1 includes information in a so-called confidential configuration 2, i.e. when the latter has not been read by at least one authorized person, it appears as shown in FIG. 1. In this case, only one masking label 3, here of rectangular shape, is visible. This label 3 comprises a series of geometric FIG. 4, advantageously in a random pattern, generally with curves and arcs and of a color similar to that in which the information 2 is mentioned. For increased readability, the geometric FIG. 4 are illustrated here in the shape of regularly interlaced rectangles. Such a label 3 conceals the confidential information 2. The latter can not be seen, and much less read, while the masking label 3 is still in place, even under specific lighting, e.g. grazing light, an ultraviolet lamp or similar.

The masking label 3 is provided, on one side 5, with a tab 6 forming a gripping member enabling the user to remove the label 3. In a non-illustrated variant, the tab is located on the side opposite the side 5. Advantageously, the tab 6 is equipped with a sign, arrows 7 in this case, indicating the direction toward which one must pull in order to remove the label 3. The tab 6 is free to move relative to the document 1 while masking label 3 is secured to the document 1 and, in the configuration of FIG. 1, integral with it.

For this, the masking label 3 is secured to the document 1 by strong, non-repositionable adhesive. The masking label 3 is secured around the periphery of a window 8 cut out in the document 1, in the area where the document defines the edges of the window 8. The respective dimensions of the window 8 and masking label 3 are such that the masking label 3 completely covers the window 8 when the masking label 3 is positioned on the window 8. To achieve this, the sides 5, 50, 51, 52 of the masking label 3 overlap onto the document 1 along all the edges 80, 81, 82, 83 of the window 8. In other words, the label 3 is larger than the window 8, so that all the edges 5, 50, 51, 52 of the masking label 3 are located on the document 1 when masking label 3 covers the window 8. As illustrated in FIG. 1, two strips 9, 10 of the masking tag 3 are devoid of masking along the edges 50, 52 of the masking label 3 intended to be secured to the document 1. As these strips 9, 10 are on the document 1, no information, at least nothing confidential by definition, is mentioned on the document at this level. In other words, these strips 9, 10, continuous and parallel, are intended to define two areas for bonding the masking label 3 to the document 1. In a variant not represented, these fastening strips 9, 10 are provided with a marking or a mask. In a non-illustrated variant, strips of the masking label 3 located adjacent to the edges 5, 51 of the masking label are also free of masking, the document being visible. Here, the rectangular window 8 has a length of 35 mm and a width of 15 mm and the masking label 3 has a length, without the tab 6, of 52 mm and a width of 38 mm.

The window 8 arranged in the document 1 is particularly visible in FIG. 3. It is made by a cutout in the document 1, using techniques known per se, for example by means of cutting dies. In this case, the window 8 is rectangular in shape, i.e. in the same shape as the masking label 3. Alternatively, it may be of another shape, for example square or circular. Similarly, the masking label 3 may be in a shape different from that of the window 8, provided that the dimensions of the masking label 3 are greater than those of the window 8 and that they are such that the masking label 3 completely covers the window 8 and all its edges overlap the document 1, when the masking label 3 is above the window 8.

As shown in FIGS. 1 and 3, two areas of structural weakness 11, 12 are arranged in the document 1, adjacent to the window 8. In this case, the areas of structural weakness 11, 12 are formed by two parallel strips precut in the document 1, located along the two edges 81, 83 parallel to the window 8. Here, as the window 8 is rectangular, the pre-cut areas 11, 12 are made along the length of the window 8. It is easy to see that the dimensions and/or shape and/or the number of areas of structural weakness 11, 12 are adapted to the configuration of the window 8 and the masking label 3. In all cases, the areas of structural weakness 11, 12 are smaller than the strips 9, 10 of the masking label 3, in order to be completely covered by the latter when the masking label 3 is secured on the document 1, directly above the window 8. The areas of structural weakness 11, 12 are advantageously arranged at a distance between 3 mm and 10 mm from the edges 81, 83 of the window. Such a distance allows the integrity of the edges 81, 83 of the window 8 to be maintained when the areas of structural weakness 11, 12 are torn.

Furthermore, if the areas of structural weakness 11, 12 are, as in the example, preferably made by discontinuous pre-cutting or punching of the document, it is possible to produce them according to another technique, also known per se. For example, they are obtained by a smaller thickness of the constituent material of the document and/or by a material of a different nature than that of the document. In a variant not represented, the areas of structural weakness have a geometric shape other than rectangular, such as triangular for example.

As shown in FIG. 1, when the masking label 3 is in place, not only the window 8 but also the areas of structural weakness 11, 12 and the parts of the document 1 adjacent to the edges 80 to 83 of the window 8 are masked by the masking label 3. It is permanently secured to the document 1 in these various areas.

FIG. 2 illustrates the configuration of the document when the masking label 3 is removed. In this configuration, not only the confidential information 2 located in the perimeter delineated by the window 8 appears but the areas of structural weakness 11, 12 provide space for two cutouts 110, 120, made in the document 1 and in the shape and dimensions substantially corresponding to those of the areas of structural weakness 11, 12. Thus, upon removal of the masking label 3, the constituent material of the document 1 in the areas of structural weakness 11, 12 is at least partially torn away. The constituent material of the areas of structural weakness 11, 12 remains secured to the masking label 3, more particularly on the fastening strips 9, 10 of the masking label 3.

As a result, any attempt to dissociate, even partially, the masking label 3 of document 1 to access the confidential information 2 is detected owing to the tearing, or at least degradation of the constituent material of the document 1 around the window 8 in which the information 2 is located. It is easy to understand that it is possible, in order to optimize the bond between the masking label 3 and the areas of structural weakness 11, 12, that the dimensions of the bonding areas of the masking label 3 of the document are variable according to the sides 5, 50, 51, 52 of the label 3. In particular, the bonding areas formed by the strips 9, 10 are larger in the areas of structural weakness 11, 12, than at the other edges of the window 8, in order to ensure complete overlapping of the areas of structural weakness 11, 12.

As can be more clearly seen in FIG. 3, the confidential information 2 is mentioned on a face 15 of the first label 16 constituent of an information support element 2. The face 15 supporting the information is the free face of the first label 16, i.e. the face from which the information 2 is read by a recipient.

This label 16 is made of an advantageously matte, transparent material. This material is, for example, polyester. When the information 2 is mentioned, for example by printing, on the face 15 of the first label 16, the information is positioned so that, when the first label 16 is in place, the information 2 is located in the window 8.

The dimensions and shape of the label 16 are adapted to be secured, in a definitive manner, by its face 17 opposite the face 15, to a face 18 of the document 1. In the example, the rectangular label 16 has a length of 48 mm and a width of 23 mm. The label 16 is secured, by means of a strong, non-repositionable adhesive, so that it cannot be separated from the document 1. The label 16 is bonded so that it completely covers the window 8, overlapping onto the document 1, along the periphery of the window 8 but without covering the areas of structural weakness 11, 12. Thus, the label 16 is bonded to the document 1 in the parts 13, 14 of the document 1 located between the edges 81, 83 and areas of structural weakness 11, 12, respectively.

The width of the part of the label 16 overlapping onto the face 18 of the document 1, thus de facto the width of the fastening strip of the label 16 on the document 1, is sufficient to ensure permanent attachment of the label 16 on the document, without disturbing the operation of the security device, while ensuring that the information 2 can be read through window 8. Typically, the width of such a fastening strip, continuous over the entire periphery of the label 16, is between 48 mm and 23 mm depending on the dimensions of the areas of structural weakness 11, 12.

A second label 19, also transparent, is secured from the face 20 of the document 1 opposite the face 18. This second label 19 may be made of the same material as the first label 16. Advantageously, it is made of a transparent and glossy material, for example polyethylene terephthalate or PET. The shape and dimensions of the label 19 are such that it is positioned in the window 8 without exceeding it. In the example, the rectangular label 19 measures 34 mm long and 14 mm wide. Thus, the label 19 is set back from the window 8 by 1 mm in width and in length in this embodiment.

The face 21 of the label 19 which is opposite the face 17 of the first label 16 ensures the bonding of the two labels 16 and 19. This bonding is permanent by techniques known per se, for example by means of a strong, non-repositionable adhesive and will not alter the light transmission, to allow the information 2 to be read.

In all cases, the information 2 is legible in the window 8, through the two labels 16, 19 when the masking label 3 is removed. The second label 19 prevents all direct contact between the first label 16 and the masking label 3 therefore, de facto, prevents all damage to the first label 16 and thus the information 2, when the masking label 3 is removed.

As can be more clearly seen in FIG. 3, the masking label 3 is secured from the face 20 of the document 1, directly above the window 8, above the label 19. The part 30 of the label 3 provided with masking patterns 4 is positioned above the label 19, thus in the window 8. A face 22 of the masking label 3 is in contact with the face 23 opposite the face 21 of the label 19. For this purpose, the face 22 of the masking label 3 is coated with a strong, non-repositionable adhesive. A treatment, known per se, is applied over the area of the face 22 intended to cover the face 23 of the label 19, to render the adhesive non-polymerizable. This so-called desensitization treatment separates the labels 3 and 19 without the adhesive remaining on the face 23 of the label 19 and risking to interfere with the reading of the information 2. This treatment consists in applying a layer of adhesive over the area of the face 22 intended to cover the face 23 of the label 19. This layer of adhesive is thinner in relation to the rest of the layer of adhesive on the face 22. By decreasing the thickness of the layer of adhesive, through removal, it is easier to separate the labels 3 and 19.

This produces a document 1 wherein the confidential information 2 is mentioned on an information support element 16, 19, located in a window 8 cut out in the document 1. The information is masked by a masking element 3, positioned directly above information 2, in the window 8, from the face 20 of the document 1 opposite the face 18 on which the information support element 16 is maintained.

The document 1 thus forms a separation between the information support element 16, 19 and the information masking element 3, in both the active configuration of the securing device, i.e. masking of the information, and in the inactive configuration, namely when one is able to access and read the information when the masking label 3 has been removed.

The window 8 defines a passage between the masking element 3 and information support element 16, 19. Such a configuration between the information masking device, the document and the information support element makes it possible to optimize the security of the information. Access to the information is independent of the document as such and without direct contact between the information and the masking element, by the presence of the label 19.

Furthermore, as can particularly be seen in FIGS. 3 and 4, only three elements 16, 19, 3 are used to support and to mask the information 2, respectively. For increased readability, in FIG. 4, the thickness of the document is overestimated, as well as a space between the second label 19 and the masking element 3 is represented, in order to facilitate identification of the various elements. It is easily understood, de facto, that the various elements are in contact. As these elements are configured in thin sheets, i.e. in the form of labels, they create only minimal extra thickness on the document 1 when they are in position. In addition, this extra thickness is distributed between the two faces 18, 20 of the document 1. For example, the masking label 3 has a thickness of approximately 0.03 mm and the two labels 16, 19 forming the information support have, at the window 8, a total thickness of approximately 0.076 mm, it being further understood that the label 19 has a thickness corresponding to that of the document and it is in place in the window. Thus, and as such, the label 19 does not form extra thickness relative to the document. As a result, in relation to the average thickness of a document 1 of approximately 0.02 mm, the security device represents only an extra thickness of approximately 0.05 mm, distributed over both faces of the document, which allows it to be used in all types of machines used in printing, such as a continuous or single-sheet type laser printer.

As can be seen in FIG. 4, a document 1 is produced wherein the information 2 and the masking element 3 of this information are secured to different and separate regions of the document 1 while being transparent to light.

Here, the concealment of the information 2 and its reading are achieved by passing light through an area of the document, the window 8, devoid of material. Information security 2 is optimal as nothing interferes, deflects or blocks the passage of light through the various masking labels 3 or information support 16, 19. With such a configuration, when the device is active it is not possible to distinguish the masking patterns 4 from the patterns forming the information.

The device of the invention uses the passage of light through transparent materials to support and conceal the confidential information 2.

Here, the document 1 is used as a neutral and separate support of the information and the masking device, which allows any constituent material of the document to be used. In other words, the constituent material of the document and its shape and/or dimensions are not directly involved in masking the information. The information is masked by the presence of masking patterns 4, the passage of light through the various labels and the window and the printing of a background.

The implementation of such a device on a document is now described in reference to FIG. 5. First of all, a cutout corresponding to the window 8 is made in a document 1, for example a sheet of paper. At the same time or not, namely initially or immediately after, the two areas of structural weakness 11, 12 are made along two parallel edges 81, 83 of the window 8. Here, the cutout of the window and the pre-cutting of the areas defining the areas of structural weakness are performed in one operation, using a single, cutting-die type tool. In a preferred embodiment, the cutout is performed on a document previously printed with information other than the confidential information. In a non-illustrated variant, the cutout and the pre-cut strips can be performed on two different machines. Alternatively, other techniques known per se can be used, such as laser cutting for example.

In a next step, positioning, all appropriate means and known per se are used to position the first label 16 from the face 18 of the document 1, on the window 8. During this step, a strong and non-repositionable adhesive is used to bond the face 17 of the label 16 on the areas 13, 14 of the document 1 located between the edges 81, 83 of window 8 and the areas of structural weakness 11, 12, taking care not to bond in the areas of structural weakness 13, 14.

After this step, the face 18 of the document 1 is equipped with a part of the information support element, namely the first label 16. This label is visible through the window 8 from the other face 21 of the document 1. The part of the label 16 on which the information 2 will be printed is thus positioned on the window 8.

The document 1 is then turned over in the direction of the arrow F so that the visible face of the document 1, in FIG. 5, is the face 20 opposite the face 18 receiving the second label 19. Once turned over, the masking element 3 is positioned and secured above the window 8.

Beforehand, advantageously, before the masking label 3 is put into place, the second label 19 was removably mounted to the label 3. To do this, the second label 19 is secured by its face 23 to the face 22 of the masking label 3. During this operation, the position of the label 19 on the label 3 is chosen so that, once the assembly is in position on the document 1, the label 19 occupies the entire face of the window 8 without overlapping on the latter. For increased readability, in FIG. 5, the label 19 is shown in dotted lines, it being understood that it is not visible when the assembly formed by the labels 3 and 19 is in place on the document 1.

It is easy to see that in other embodiments, second label 19 and the masking element 3 are positioned successively. In other words, in this case, the labels 19 and 3 are not pre-assembled. During this step, it is ensured that the entire window 8 is masked and that the two areas of structural weakness 11, 12 are fully covered by the two lateral strips 9, 10 of the masking label 3. The masking label 3 is definitively secured by strong, non-repositionable adhesive on the document 1, adjacent to the circumference 80 to 83 of the window 8 and the areas of structural weakness 11, 12. Only the gripping member, thus the tab 6, is not secured to the document 1, as it is devoid of adhesive.

Advantageously, the adhesive used is similar to that used to bond the first label 16 to the other face 18 of the document 1. Alternatively, the adhesives are different.

Preferably, in the contact area between the two labels 3 and 19, i.e. at the window 8, the adhesive is weak and repositionable owing to the desensitization treatment. This thus remains mainly on the face 22 of the label 3 when it is removed, so as not to change the optical characteristics of the label 19, i.e. so as not to disturb the reading of the information 2 by the window 8 when the masking label 3 is removed.

Only the strips 9, 10, 5, 51 of the masking label 3 are provided with a strong and non-repositionable adhesive on the face 22 side of the label 3.

The document 1 is then turned over in the direction of the arrow F1, so that the visible face of the FIG. 5 is the face 18 of the document 1. The first label 16 receives the information 2 on its face 15. The information is printed so that the recipient can read it from the face 20 of the document when the masking label 3 is removed.

Advantageously, the various steps are performed out in a discontinuous manner. Typically, the step of securing the various labels 3, 16, 19 of the document 1 are performed in one location and/or at a given time. The information 2 is printed in a remote location and/or at another time, therefore independently of the steps mentioned above. In other words, it is the end user providing the confidential information who performs the last step consisting of affixing the information to the document 1, the latter being already provided with other components of the security device.

It is understood that these steps can be performed continuously, i.e. in a single operation, the delivered document being delivered ready to receive the code by an approved user, referred to as the customizer.

The invention claimed is:

1. A document (1) provided with a device for securing confidential information (2) mentioned in the document, the latter comprising:

a window (8) cut into said document, at least two areas of structural weakness (11, 12) located adjacent to two edges (81, 83) of the window (8), an information support element formed by at least a first label (16) secured to one face (18) of the document (1) such that the confidential information (2) printed on said label (16) is located in the window (8), an element for masking (3) the confidential information (2), with dimensions at least equal to those of the window (8), permanently secured to the areas of structural weakness (11, 12) and removably mounted at the window (8), characterized in that a second label (19) component of the information support element is arranged in the window (8) of the document (1), the second label (19) being adapted to protect the first label (16) and to enable the confidential information (2) to be read in the window (8) through the two labels (16, 19) when the masking element (3) is removed from the face (20) of the document (1) opposite to the face (18) provided with the first label (16) on which the confidential information (2) is printed, the dimensions of the second label (19) being smaller than those of the window (8), and in that the masking element (3) is also located on the face (20) of the document opposite the face (18) provided with the first label (16) on which the confidential information (2) is printed, said masking element (3) further having dimensions such that it is permanently secured, by all its sides (5, 50 to 52, 9, 10) on the document, adjacent to all the edges (80 to 83) of the window (8), including those (80, 82) without areas of structural weakness (11, 12), wherein said masking element (3) and information support element are secured to different and separate regions of the document (1), at least said information support element being transparent to light.

2. The document as claimed in claim 1, characterized in that the dimensions and shape of the first label (16) bearing the information (2) are adapted to cover the window (8) and a part (13, 14) of the document forming the edges (80 to 83) of the window (8) except for the areas of structural weakness (11, 12).

3. The document as claimed in claim 1, characterized in that the masking element (3) and the first label (16), are secured to the two opposite faces (18, 20) of the document (1) by means of a strong and non-repositionable adhesive.

4. The document as claimed in claim 1, characterized in that the second label (19) is secured by a strong, non-repositionable adhesive on the first label (16).

5. The document as claimed in claim 1, characterized in that the face (23) of the second label (19) in contact with the masking element (3), at the window (8), is devoid of adhesive.

6. The document as claimed in claim 1, characterized in that the face (23) of the second label (19) in contact with the masking element (3), at the window (8) is secured (21) to said masking element (3) by a weak, repositionable adhesive.

7. The document as claimed in claim 1, characterized in that at least the first (16) and second (19) labels are made of a transparent material.

8. The document as claimed in claim 7, characterized in that the first label (16) is made of a matte and transparent material.

9. The document as claimed in claim 7, characterized in that the second label (19) is made of a glossy and transparent material, for example PET.

10. A method for implementing a document (1) equipped with a device for securing confidential information (2) as claimed in claim 1, characterized in that it comprises at least the following steps:

a) make a cutout, defining a window (8), in a document (1), b) define two areas of structural weakness (11, 12) parallel to two sides (81, 83) of the window (8) and adjacent to said sides, c) secure a first label (16), forming a component of the information support element, to a face (18) of the document (1) so that it covers the entire window (8) without overlapping on the areas of structural weakness (11, 12), d) secure, at the window (8), a second label (19), forming part of the information support element, on the first label (16) previously secured to the document in step c), the second label (19) not overlapping the window (8), e) turn (F) the document (1) over to secure a masking element (3) to the document (1) so that it covers the entire window (8), the second label (19), the perimeter (13, 14) of the window (8) and the areas of structural weakness (11, 12), the masking element (3) being secured on the face (20) of the document (1) opposite the face (18) on which the first label (16) forming part of the information support element is secured, f) turn (F1) the document (1) over to print the confidential information (2) on the free face (15) of the first label (16), so that the information (2) is positioned in the window (8) and viewable from the face (20) when the masking element (3) is removed, wherein said masking element (3) and information support element are secured to different and separate regions of the document (1), at least said information support element being transparent to light.

11. The method as claimed in claim 10, characterized in that steps a) and b) of cutting the window (8) and creating the areas of structural weakness (11, 12) are performed simultaneously.

12. The method as claimed in claim 10, characterized in that the step b) of creating the areas of structural weakness (11, 12) is performed before step a).

13. The method as claimed in claim 10, characterized in that the steps d) and e) of securing the second label (19) and the masking element (3) are performed simultaneously, the second label (19) being pre-positioned on the masking element (3).

14. The method as claimed in claim 10, characterized in that the step f) of printing the information (2) is performed in one location and/or at a different time from other steps.

* * * * *